US008886493B2

(12) United States Patent
Taylor

(10) Patent No.: US 8,886,493 B2
(45) Date of Patent: Nov. 11, 2014

(54) DETERMINING DIPPER GEOMETRY

(75) Inventor: Wesley P. Taylor, Glendale, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 457 days.

(21) Appl. No.: 13/286,380

(22) Filed: Nov. 1, 2011

(65) Prior Publication Data

US 2013/0110460 A1 May 2, 2013

(51) Int. Cl.

| | |
|---|---|
| ***G06F 15/00*** | (2006.01) |
| ***G01B 5/02*** | (2006.01) |
| ***E02F 3/46*** | (2006.01) |
| ***E02F 9/20*** | (2006.01) |
| ***E02F 3/30*** | (2006.01) |
| ***E02F 3/60*** | (2006.01) |

(52) U.S. Cl.

CPC ..... *E02F 3/46* (2013.01); *E02F 9/2025* (2013.01); *E02F 3/305* (2013.01); *E02F 3/60* (2013.01); *E02F 3/308* (2013.01)

USPC ..... 702/158; 701/50; 702/97; 702/151

(58) Field of Classification Search

CPC ..... E02F 3/30; E02F 9/006; E02F 9/24; E02F 3/305; E02F 3/308; E02F 3/437; E02F 3/46; E02F 3/60; E02F 9/2025; E02F 9/2033; G01G 19/18; G01G 3/141; G01L 5/101; G05D 1/0278; G05D 2201/0202

USPC ..... 702/94, 105, 113, 150, 151, 158, 174, 702/85, 97; 701/31.4, 50; 37/348, 396, 468; 177/139; 318/568.18; 340/686.1

See application file for complete search history.

(56) References Cited

U.S. PATENT DOCUMENTS

| | | | |
|---|---|---|---|
| 4,491,927 | A | 1/1985 | Bachmann et al. |
| 4,677,579 | A | 6/1987 | Radomilovich |
| 4,809,794 | A | 3/1989 | Blair et al. |
| 5,408,767 | A | 4/1995 | Hazama et al. |
| 5,748,097 | A | 5/1998 | Collins |
| 6,025,686 | A | 2/2000 | Wickert et al. |
| 6,225,574 | B1 | 5/2001 | Chang et al. |
| 6,336,077 | B1 | 1/2002 | Boucher |
| 6,480,773 | B1 | 11/2002 | Hilgart |
| 6,691,437 | B1 | 2/2004 | Yost et al. |
| 7,426,796 | B2 | 9/2008 | Cunningham et al. |
| 7,640,683 | B2 | 1/2010 | McCain |

(Continued)

FOREIGN PATENT DOCUMENTS

| | | |
|---|---|---|
| AU | 5826586 | 1/1987 |

*Primary Examiner* — John H Le

(74) *Attorney, Agent, or Firm* — Michael Best & Friedrich LLP

(57) ABSTRACT

Determining dipper geometry. A method of determining dipper geometry includes obtaining a first set of data associated with an industrial machine for a first orientation of the industrial machine, and obtaining a second set of data associated with the industrial machine for a second orientation of the industrial machine. The first set of data includes at least one of a first length associated with a hoist rope and a first angle associated with the hoist rope, and the second set of data includes at least one of a second length associated with the hoist rope and a second angle associated with the hoist rope. The value of the physical characteristic of the dipper is then determined based on the first set of data and the second set of data.

20 Claims, 11 Drawing Sheets

(56) References Cited

U.S. PATENT DOCUMENTS

| | | | | |
|---|---|---|---|---|
| 7,734,397 | B2 | 6/2010 | Peterson et al. | |
| 8,032,313 | B2 * | 10/2011 | Claxton | 702/42 |
| 8,209,096 | B2 * | 6/2012 | Claxton | 701/50 |
| 2009/0018718 | A1 | 1/2009 | Lang et al. | |
| 2009/0187527 | A1 | 7/2009 | McAree et al. | |
| 2010/0010714 | A1 | 1/2010 | Claxton et al. | |
| 2010/0283675 | A1 | 11/2010 | McAree et al. | |
| 2011/0029279 | A1 | 2/2011 | McAree et al. | |

* cited by examiner

DETERMINING DIPPER GEOMETRY

BACKGROUND

This invention relates to determining the geometry of a dipper installed on an industrial machine, such as a rope shovel.

SUMMARY

Industrial machines, such as electric rope or power shovels, draglines, etc., include an installed dipper for performing a digging operating. In order to determine the location of the dipper (e.g., the location of the dipper teeth), control systems associated with the industrial machines must be programmed or pre-configured to take the geometry of the dipper into account when determining its position. Such programming is often performed manually by a service representative who manually enters, into a system, dimensions and other calibration parameters associated with the dipper that are required to determine the dipper's correct position. Such a process can be tedious and can vary from industrial machine to industrial machine. For example, a particular industrial machine may be configured for use with a variety of different dippers (e.g., dippers of different sizes). Additionally, the dipper that is installed on an industrial machine may be changed depending on digging conditions, material characteristics, etc. In such instances, the control systems of the industrial machine would have to be manually recalibrated to accommodate the new dipper and correctly determine its position. If the control systems of the industrial machine are not calibrated properly for the geometry of the installed dipper, the industrial machine may not, for example, be able to avoid collisions between the dipper and other parts of the industrial machine (e.g., a boom).

As such, the invention provides an automated method of determining the geometry of a dipper and calibrating control systems of an industrial machine in order to, among other things, determine an accurate position of the dipper, avoid collisions, measure accurate payloads, etc.

In one embodiment, the invention provides a method of determining a value of a physical characteristic associated with a dipper of an industrial machine. The method includes obtaining a first set of data associated with the industrial machine for a first orientation of the industrial machine. The first set of data includes at least one of a first length associated with a hoist rope and a first angle associated with the hoist rope. The method also includes obtaining a second set of data associated with the industrial machine for a second orientation of the industrial machine. The second set of data includes at least one of a second length associated with the hoist rope and a second angle associated with the hoist rope. The value of the physical characteristic of the dipper is then determined based on the first set of data and the second set of data.

In another embodiment, the invention provides an industrial machine that includes a dipper, a controller, a boom, and a sheave. The boom and the sheave support a hoist rope, and the hoist rope is connected to the dipper. The controller is configured to control a length of the hoist rope, determine a first length of the hoist rope corresponding to a first position of the dipper, determine a second length of the hoist rope corresponding to a second position of the dipper, determine a first angle of the hoist rope with respect to the sheave and corresponding to the first position of the dipper, and determine a second angle of the hoist rope with respect to the sheave and corresponding to the second position of the dipper. The controller is also configured to determine a displacement of the hoist rope and determine a value for a physical attribute of the dipper based on the displacement of the hoist rope.

In another embodiment, the invention provides a method of determining a value for a length associated with a dipper of an industrial machine. The method includes determining a first length of a hoist rope associated with a first position of the dipper, determining a first angle of the hoist rope with respect to a sheave and associated with the first position of the dipper, determining a second length of the hoist rope associated with a second position of the dipper, and determining a second angle of the hoist rope with respect to the sheave and associated with the second position of the dipper. The method also includes determining the value for the length associated with the dipper based on the first length of the hoist rope, the second length of the hoist rope, the first angle of the hoist rope with respect to the sheave, and the second angle of the hoist rope with respect to the sheave.

Other aspects of the invention will become apparent by consideration of the detailed description and accompanying drawings.

DETAILED DESCRIPTION

Figure 1:
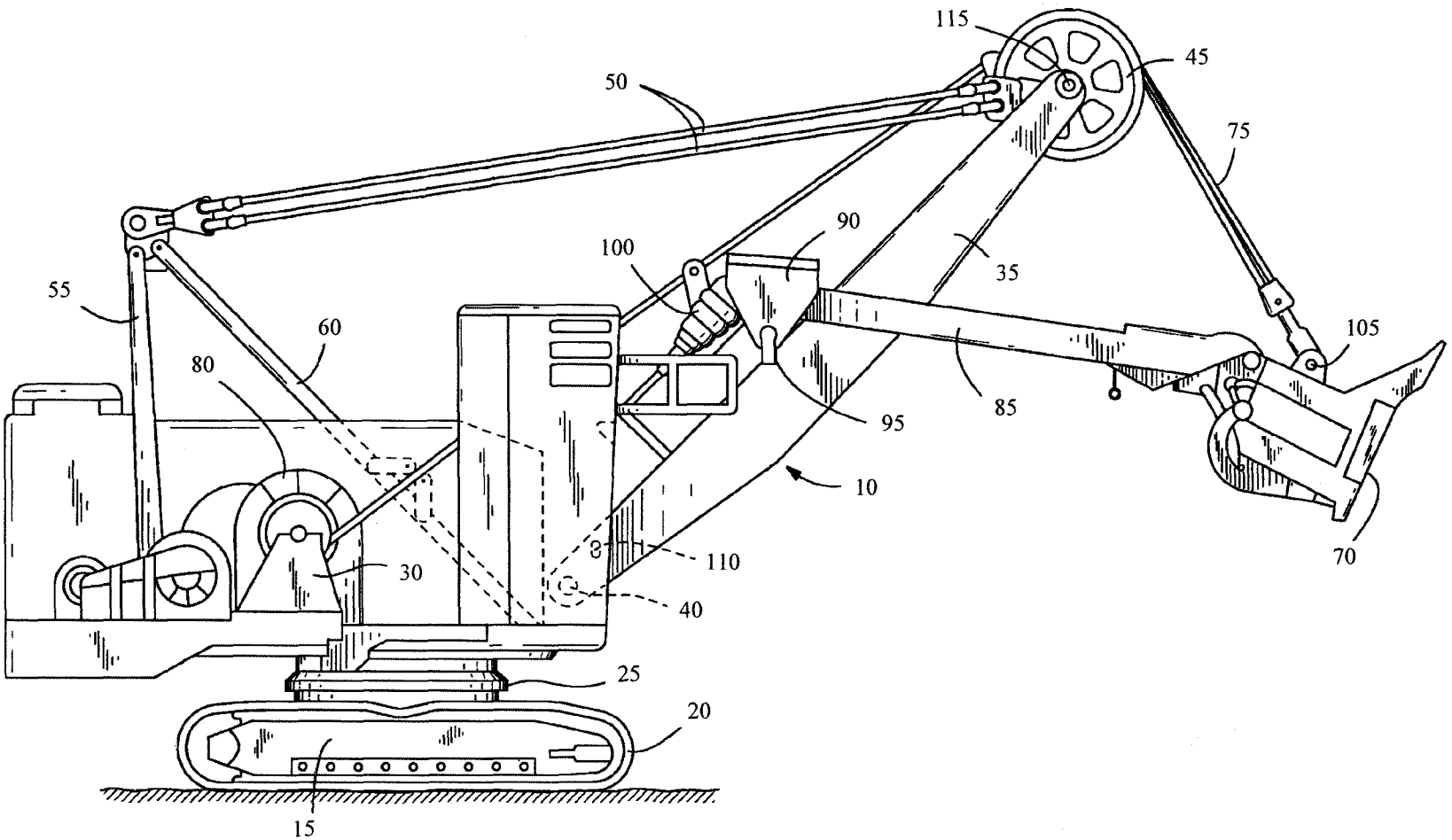
FIG. 1 illustrates an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention.

Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

The invention relates to determining the geometry of a dipper associated with an industrial machine (e.g., a rope shovel). The geometry or physical characteristics of the dipper include, for example, the length of the dipper (e.g., the length of the dipper from the dipper teeth to a bail pin connection, a dipper handle connection, etc.) or the angle of the dipper with respect to the dipper handle. Such attributes or characteristics of the dipper are used by a variety of control systems of the industrial machine for the purpose of collision avoidance, payload determination, position detection, etc. A controller of the industrial machine is configured in such a manner to automatically calculate or determine the characteristics or attributes of the dipper without requiring manual calibration for entry of the characteristics or attributes. The controller uses, for example, a combination of known data and unknown variables to determine or calculate the length of the dipper and the angle of the dipper with respect to a dipper handle or another component of the industrial machine. The length of the dipper and the angle of the dipper can be calculated or determined based on a first orientation of the industrial machine (e.g., corresponding to a first dipper position) and a second orientation of the industrial machine (e.g., corresponding to a second dipper position).

Although the invention described herein can be applied to, performed by, or used in conjunction with a variety of industrial machines (e.g., a rope shovel, a dragline, AC machines, DC machines, hydraulic machines, etc.), embodiments of the invention described herein are described with respect to an electric rope or power shovel, such as the power shovel 10 shown in FIG. 1. The shovel 10 includes a mobile base 15, drive tracks 20, a turntable 25, a machinery deck 30, a boom 35, a lower end 40, a sheave 45, tension cables 50, a back stay 55, a stay structure 60, a dipper 70, one or more hoist ropes 75, a winch drum 80, dipper arm or handle 85, a saddle block 90, a pivot point 95, a transmission unit 100, a bail pin 105, an inclinometer 110, and a sheave pin 115. In some embodiments, the invention can be applied to an industrial machine including, for example, a single legged handle, a stick (e.g., a tubular stick), or a hydraulic cylinder actuating a crowd motion.

The mobile base 15 is supported by the drive tracks 20. The mobile base 15 supports the turntable 25 and the machinery deck 30. The turntable 25 is capable of 360-degrees of rotation about the machinery deck 30 relative to the mobile base 15. The boom 35 is pivotally connected at the lower end 40 to the machinery deck 30. The boom 35 is held in an upwardly and outwardly extending relation to the deck by the tension cables 50 which are anchored to the back stay 55 of the stay structure 60. The stay structure 60 is rigidly mounted on the machinery deck 30, and the sheave 45 is rotatably mounted on the upper end of the boom 35.

The dipper 70 is suspended from the boom 35 by the hoist rope(s) 75. The hoist rope 75 is wrapped over the sheave 45 and attached to the dipper 70 at the bail pin 105. The hoist rope 75 is anchored to the winch drum 80 of the machinery deck 30. As the winch drum 80 rotates, the hoist rope 75 is paid out to lower the dipper 70 or pulled in to raise the dipper 70. The dipper handle 85 is also rigidly attached to the dipper 70. The dipper handle 85 is slidably supported in a saddle block 90, and the saddle block 90 is pivotally mounted to the boom 35 at the pivot point 95. The dipper handle 85 includes a rack tooth formation thereon which engages a drive pinion mounted in the saddle block 90. The drive pinion is driven by an electric motor and transmission unit 100 to extend or retract the dipper arm 85 relative to the saddle block 90.

An electrical power source is mounted to the machinery deck 30 to provide power to one or more hoist electric motors for driving the winch drum 80, one or more crowd electric motors for driving the saddle block transmission unit 100, and one or more swing electric motors for turning the turntable 25. Each of the crowd, hoist, and swing motors can be driven by its own motor controller or drive in response to control signals from a controller, as described below.

Figure 2:
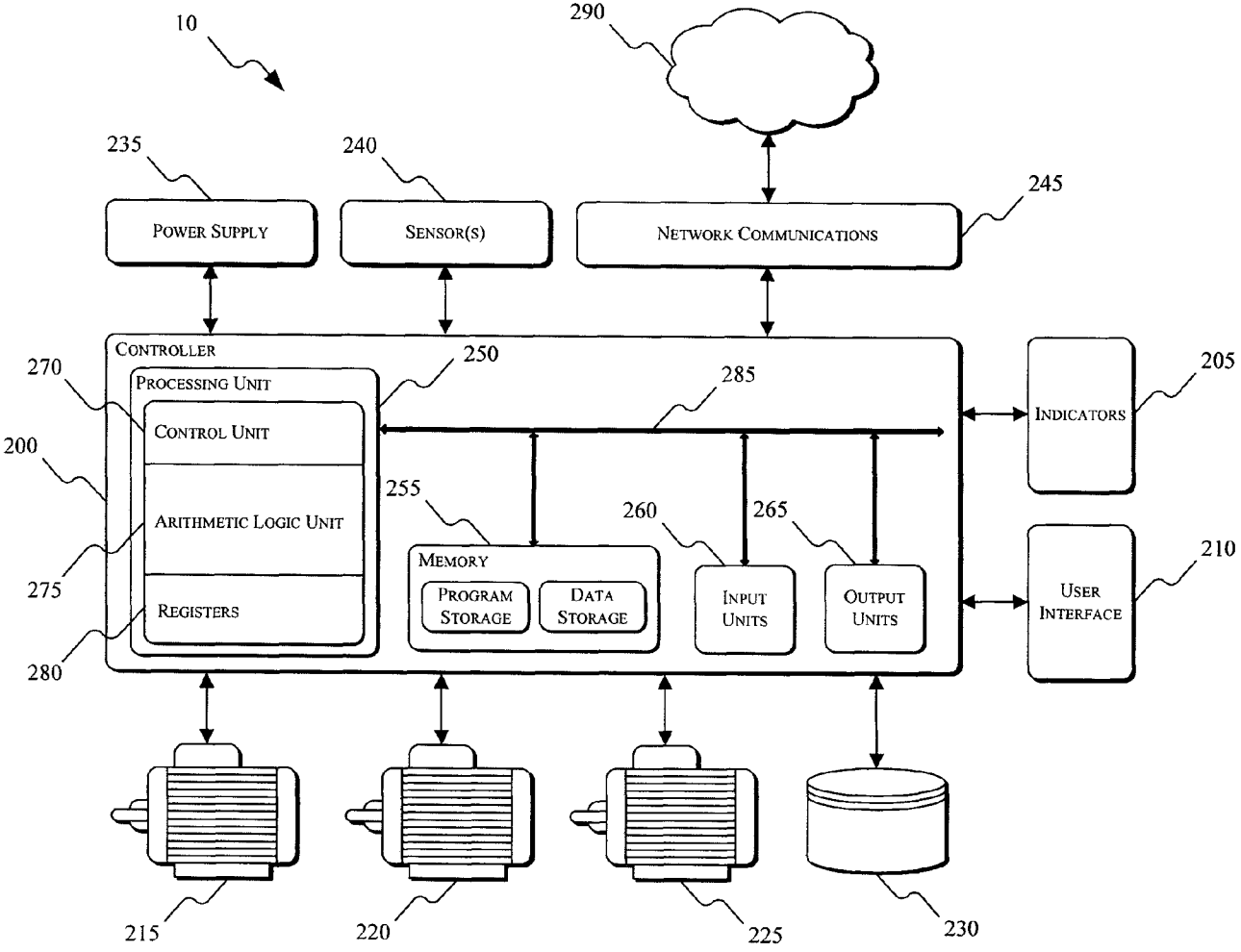
FIG. 2 illustrates a controller for an industrial machine according to an embodiment of the invention.

FIG. 2 illustrates a controller 200 associated with the power shovel 10 of FIG. 1. The controller 200 is electrically and/or communicatively connected to a variety of modules or components of the shovel 10. For example, the illustrated controller 200 is connected to one or more indicators 205, a user interface module 210, one or more hoist motors and hoist motor drives 215, one or more crowd motors and crowd motor drives 220, one or more swing motors and swing motor drives 225, a data store or database 230, a power supply module 235, one or more sensors 240, and a network communications module 245. The controller 200 includes combinations of hardware and software that are operable to, among other things, control the operation of the power shovel 10, control the position of the boom 35, the dipper arm 85, the dipper 70, the length of the hoist rope 75, etc., activate the one or more indicators 205 (e.g., a liquid crystal display ["LCD"]), monitor the operation of the shovel 10, etc. The one or more sensors 240 include, among other things, a loadpin strain gauge, the inclinometer 110, gantry pins, one or more motor field modules, etc. The loadpin strain gauge includes, for example, a bank of strain gauges positioned in an x-direction (e.g., horizontally) and a bank of strain gauges positioned in a y-direction (e.g., vertically) such that a resultant force on the loadpin can be determined. In some embodiments, a crowd drive other than a crowd motor drive can be used (e.g., a crowd drive for a single legged handle, a stick, a hydraulic cylinder, etc.).

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor (e.g., a field-programmable gate array ["FPGA"] semiconductor) chip, such as a chip developed through a register transfer level ("RTL") design process.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The network communications module 245 is configured to connect to and communicate through a network 290. In some embodiments, the network is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 290 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network 290 by the network communications module 245 or the controller 200 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections between the network communications module 245 and the network 290 are, for example, wired connections, wireless connections, or a combination of wireless and wired connections. Similarly, the connections between the controller 200 and the network 290 or the network communications module 245 are wired connections, wireless connections, or a combination of wireless and wired connections. In some embodiments, the controller 200 or network communications module 245 includes one or more communications ports (e.g., Ethernet, serial advanced technology attachment ["SATA"], universal serial bus ["USB"], integrated drive electronics ["IDE"], etc.) for transferring, receiving, or storing data associated with the shovel 10 or the operation of the shovel 10.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 70, the position of the boom 35, the position of the dipper handle 85, the transmission unit 100, etc. The user interface module 210 includes a combination of digital and analog input or output devices required to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the power shovel 10, the position of the dipper 70, the position of the dipper handle 85, the geometry of the dipper 70, etc. In some implementations, the user interface module 210 is controlled in conjunction with the one or more indicators 205 (e.g., LEDs, speakers, etc.) to provide visual or auditory indications of the status or conditions of the power shovel 10.

Figure 3:
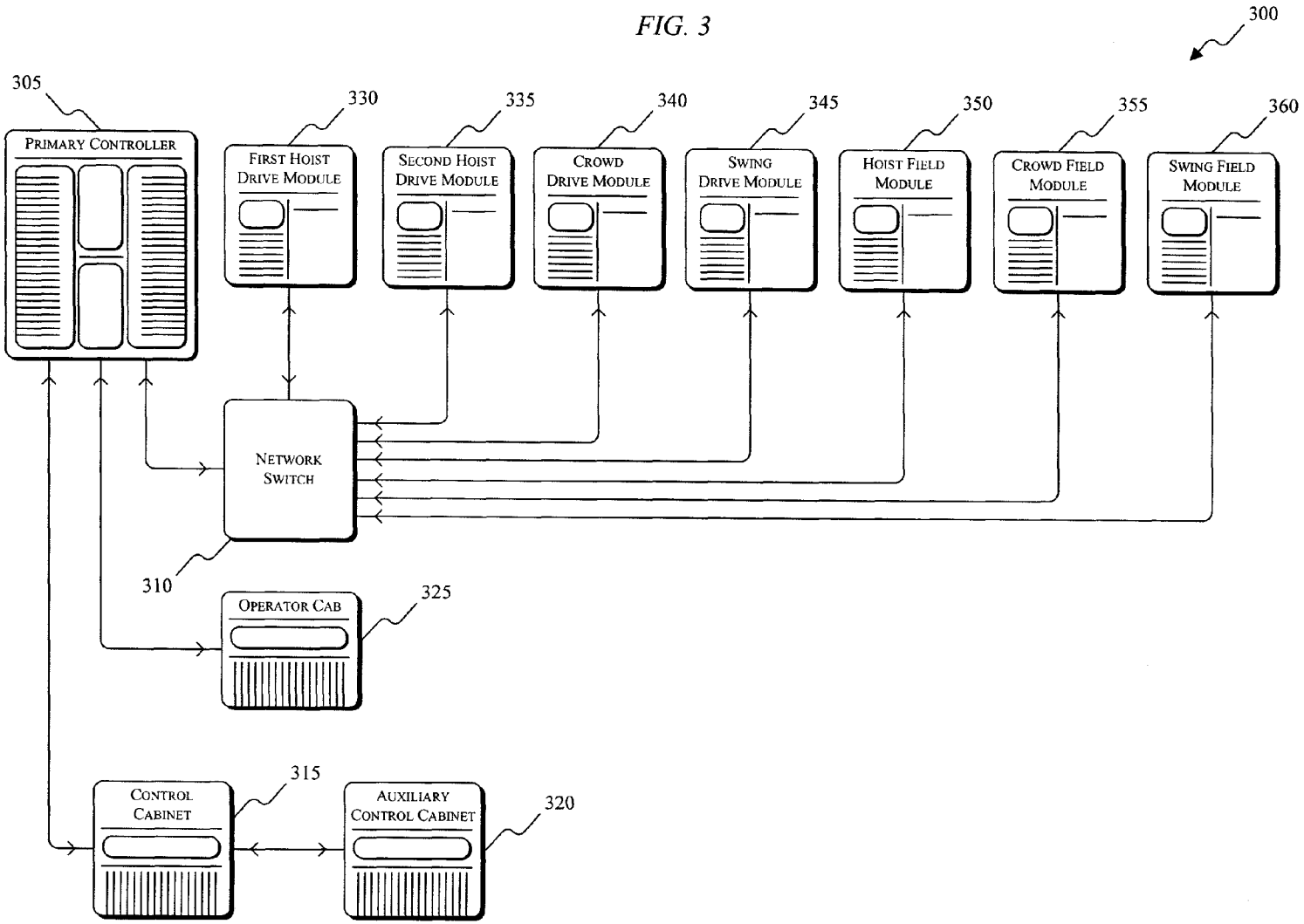
FIG. 3 illustrates a control system for an industrial machine according to an embodiment of the invention.

FIG. 3 illustrates a more detailed control system 300 for the power shovel 10. For example, the power shovel 10 includes a primary controller 305, a network switch 310, a control cabinet 315, an auxiliary control cabinet 320, an operator cab 325, a first hoist drive module 330, a second hoist drive module 335, a crowd drive module 340, a swing drive module 345, a hoist field module 350, a crowd field module 355, and a swing field module 360. The various components of the control system 300 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 400 can include the components and modules described above with respect to FIG. 2. For example, the one or more hoist motors and/or drives 215 correspond to first and second hoist drive modules 330 and 335, the one or more crowd motors and/or drives 220 correspond to the crowd drive module 340, and the one or more swing motors and/or drives 225 correspond to the swing drive module 345. The user interface 210 and the indicators 205 can be included in the operator cab 325, etc. The loadpin strain gauge, the inclinometer 110, and the gantry pins can provide electrical signals to the primary controller 305, the controller cabinet 315, the auxiliary cabinet 320, etc.

The first hoist drive module 330, the second hoist drive module 335, the crowd drive module 340, and the swing drive module 345 are configured to receive control signals from, for example, the primary controller 305 to control hoisting, crowding, and swinging operations of the shovel 10. The control signals are associated with drive signals for hoist, crowd, and swing motors 215, 220, and 225 of the shovel 10. As the drive signals are applied to the motors 215, 220, and 225, the outputs (e.g., electrical and mechanical outputs) of the motors are monitored and fed back to the primary controller 305 (e.g., via the field modules 350-360). The outputs of the motors include, for example, motor speed, motor torque, motor power, motor current, etc. Based on these and other signals associated with the shovel 10 (e.g., signals from the inclinometer 110), the primary controller 305 is configured to determine or calculate one or more characteristics, operational states, or positions of the shovel 10 or its components (e.g., the dipper). In some embodiments, the primary controller 305 determines a dipper position, a dipper handle angle or position, a hoist rope wrap angle, a hoist motor rotations per minute ("RPM"), a crowd motor RPM, a dipper speed, a dipper acceleration, dipper geometry, etc.

The characteristics of the shovel 10 that are determined by the primary controller 305 or the controller 200 are used by, for example, a collision avoidance or other control system of the shovel 10 to accurately determine the position of the dipper 70, accurately characterize the operational state of the shovel 10, etc. However, in order for the controller 200 to accurately determine such information, characteristics of the dipper's geometry must be known. For example, the length of the dipper 70 and the angle of the dipper 70 with respect to the dipper handle 85 must be known in order to determine the position of the dipper teeth with respect to the boom 35 (e.g., to prevent a collision). As described above, such information is often manually entered or programmed into a control system of the shovel 10, and the shovel 10 is calibrated based on the entered information. The information needs to be manually entered or updated each time the dipper 70 on the shovel 10 is changed. Because of the time needed to properly install a dipper 70 and calibrate the control systems of a shovel for the geometry of the dipper 70, the productivity of the shovel 10 is reduced. In order to limit the time required to calibrate the shovel 10 for an installed dipper 70, the controller 200 is configured to automatically determine the geometry of the dipper 70.

Figure 4:
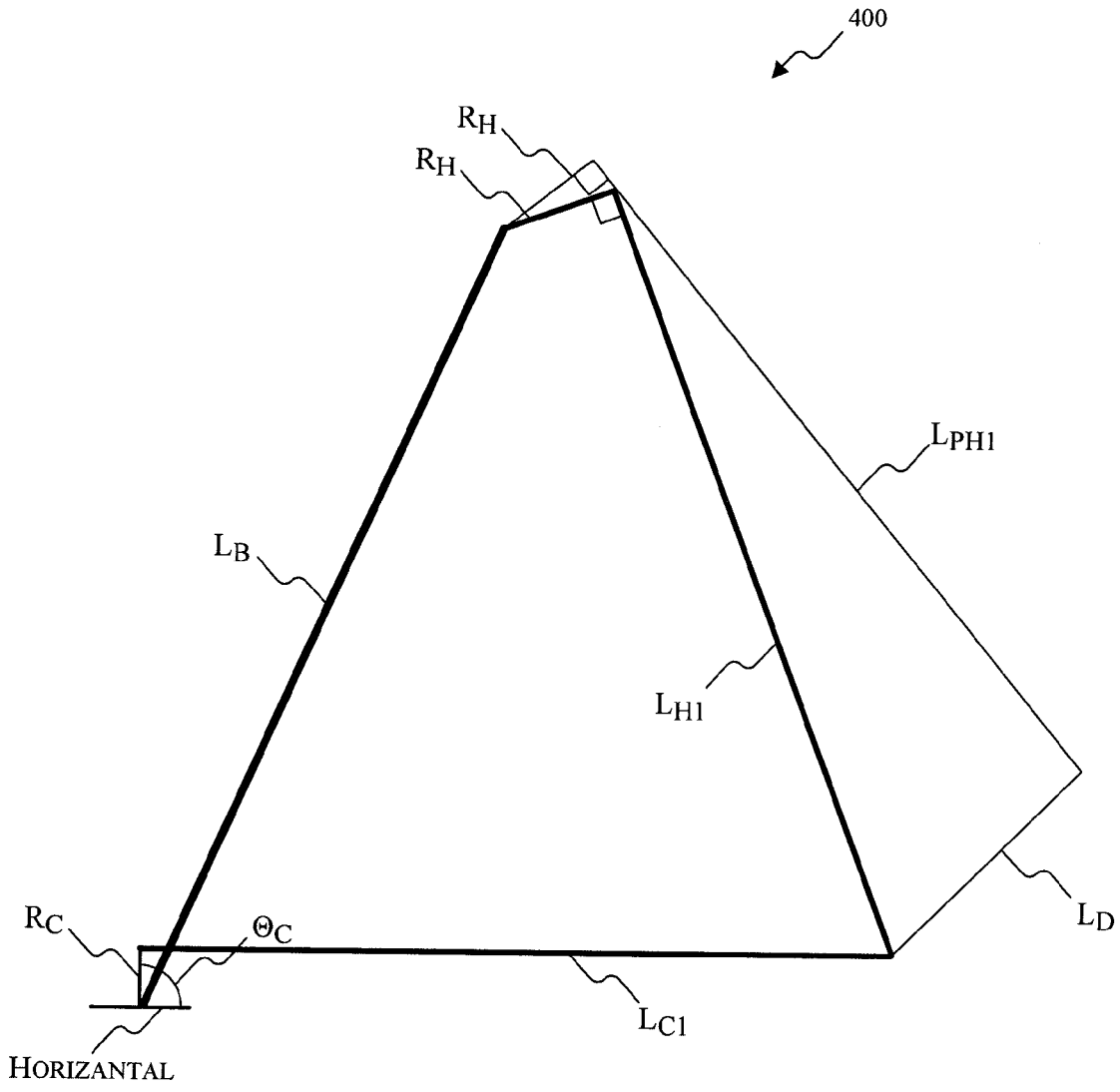
FIGS. 4-8 illustrate geometric line drawings associated with a portion of an industrial machine.

Specifically, the controller 200 is configured to use known characteristics of the shovel 10 and measured quantities associated with first and second dipper positions to determine dipper geometry. For example, FIG. 4 illustrates a line drawing of a first orientation 400 of the shovel 10 corresponding to a first dipper position and a first set of data associated with the industrial machine 10. Each of the illustrated lines is indicative of a portion of the shovel 10. In FIG. 4, the values associated with the shovel 10 that are known or can be measured include a length of the boom 35, $L_B$, a radius of the dipper handle 85, $R_C$, an angle of the dipper handle 85 with respect to horizontal (e.g., horizontal to a ground surface), $\theta_C$, the radius of the hoist sheave 45, $R_H$, a length of the dipper handle 85, $L_{C1}$, and a length of the hoist rope 75 (i.e., from hoist sheave 45 to bail pin 105) for the first dipper position, $L_{H1}$. While the length of the hoist rope 75, $L_{H1}$, represents the length of the hoist rope between the hoist sheave 45 and the bail pin 105, the length of the hoist rope 75, $L_{H1}$, does not take into account the length, $L_H$, of the dipper 70 or the angle, $\theta_H$, of the dipper 70 with respect to the dipper handle 85. The controller 200 cannot reliably prevent collisions between the dipper 70 and other components of the shovel 10 unless the controller 200, or a separate collision avoidance system, knows an accurate length, $L_H$, of the dipper 70 and angle, $\theta_H$, of the dipper 70. The length, $L_H$, of the dipper 70 and the angle, $\theta_H$, of the dipper 70 can be determined based in part on the length, $L_{PH1}$, from the hoist sheave 45 to the end of the dipper 70 and the length, $L_{H1}$, from the hoist sheave 45 to the bail pin 105.

Figure 5:
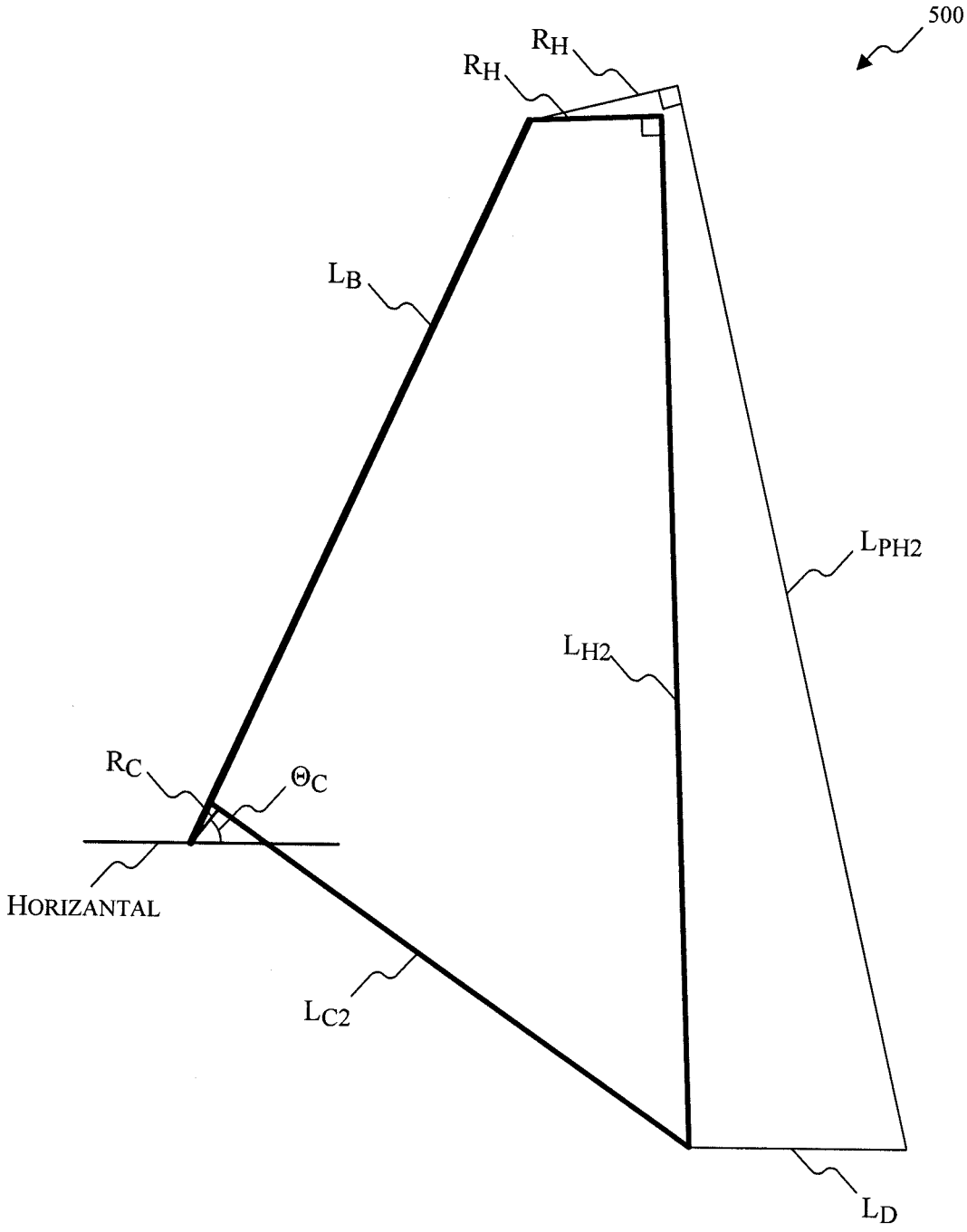

FIG. 5 illustrates a line drawing of a second orientation 500 of the shovel 10 corresponding to a second dipper position and a second set of data associated with the industrial machine 10. The length of the boom 35, $L_B$, the radius of the dipper handle 85, $R_C$, and the radius of the hoist sheave 45, $R_H$, have the same values in the second dipper position as they did for the first dipper position. Additionally, the length of the dipper handle 85, $L_{C2}$, is selected to be the same as the length of the dipper handle 85, $L_{C1}$, for the first dipper position. This is done to simplify the determination of the dipper geometry. However, in some embodiments, the length of the dipper handle 85 between the first dipper position and the second dipper position may vary. The length of the hoist rope (i.e., from hoist sheave 45 to bail pin 105) for the first position, $L_{H1}$, and the length of the hoist rope for the second dipper position, $L_{H2}$, can be determined based on a number of hoist resolver counts, $H_{RC}$, and a hoist resolver gain, $H_{RG}$. The angles, $\theta_H$, of the hoist wrap about the hoist sheave 45 can also be determined using the hoist resolver counts, $H_{RC}$, the hoist resolver gain, $H_{RG}$, and the radius of the hoist sheave 45, $R_H$.

The length of the dipper handle 85, $L_C$, and the angle of the dipper handle 85 with respect to horizontal (e.g., horizontal to a ground surface), $\theta_C$, can also be determined for the first and second dipper positions using crowd resolver counts, $C_{RC}$, and a crowd resolver gain, $C_{RG}$. As described above with respect to the first dipper position, the length, $L_H$, of the dipper 70 and the angle, $\theta_H$, of the dipper 70 can be determined based on the length, $L_{PH2}$, from the hoist sheave 45 to the end of the dipper 70 and the length, $L_{H2}$, from the hoist sheave 45 to the bail pin 105.

Figure 6:
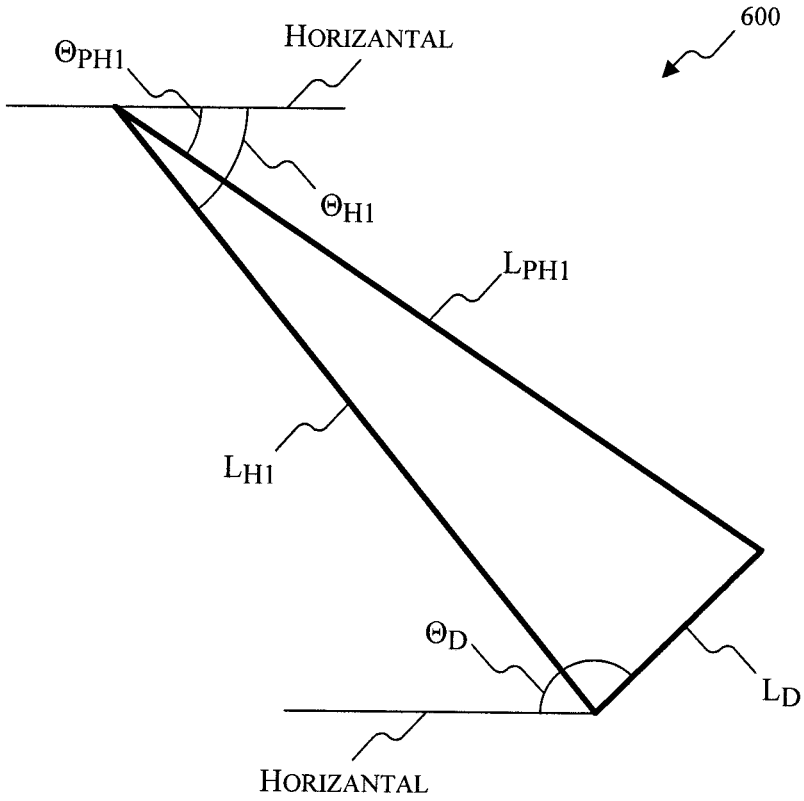

In order to determine the length, $L_D$, and the angle, $\theta_D$, of the dipper 70, the orientation of the shovel 10 corresponding to the first dipper position and the orientation of the shovel 10 corresponding to the second dipper position are further analyzed. For example, FIG. 6 illustrates a triangle 600 formed from the hoist sheave 45, the bail pin 105, and the edge of the dipper 70 for the first dipper position. The edges of the triangle correspond to the length, $L_{H1}$, of the hoist rope 75 from the hoist sheave 45 to the bail pin 105, the length, $L_D$, of the dipper 70, and the length, $L_{PH1}$, from the hoist sheave 45 to the end of the dipper 70. Using the triangle 600, three angles can be defined. The angle, $\theta_D$, of the dipper 70 with respect to the dipper handle 85, the angle, $\theta_{PH1}$, between the horizontal and the line defining the length, $L_{PH1}$, and the angle, $\theta_H$', with respect to the sheave 45 and between the horizontal and the line defining the length, $L_{H1}$.

Figure 7:
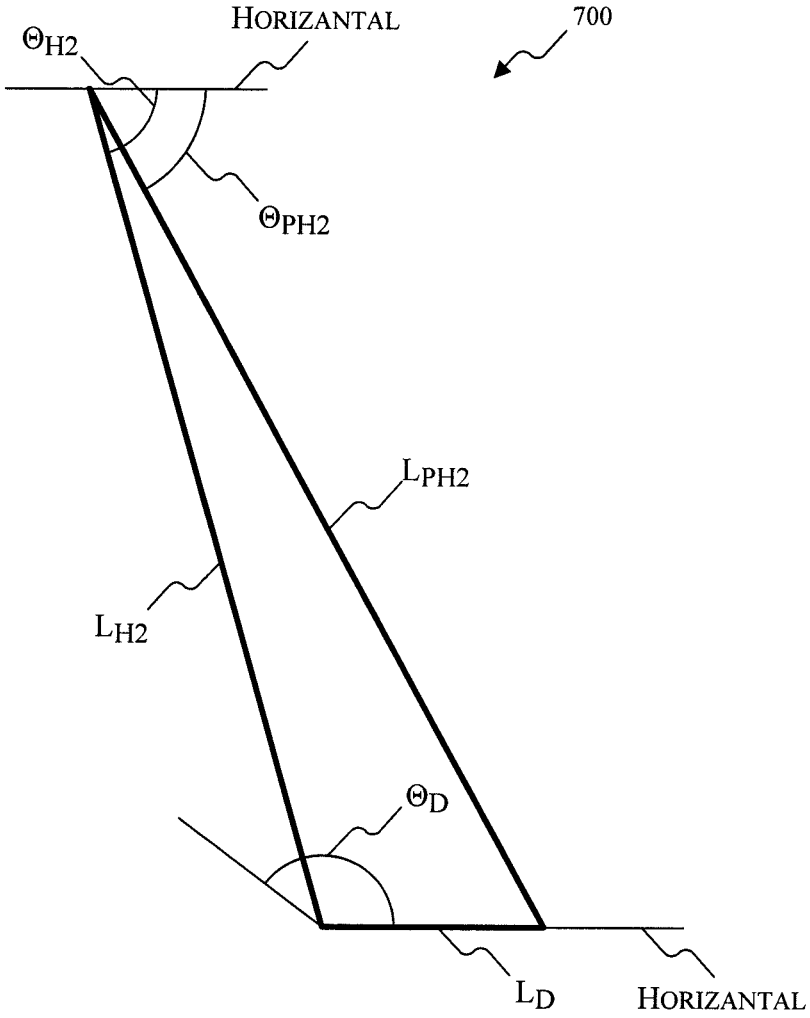

Similarly, FIG. 7 illustrates a triangle 700 formed from the hoist sheave 45, the bail pin 105, and the edge of the dipper 70 for the second dipper position. The edges of the triangle correspond to the length, $L_{H2}$, of the hoist rope from the hoist sheave 45 to the bail pin 105, the length, $L_D$, of the dipper 70, and the length, $L_{PH2}$, from the hoist sheave 45 to the end of the dipper 70. Using the triangle 700, three angles can again be defined. The angle, $\theta_D$, of the dipper with respect to the dipper handle 85, the angle, $\theta_{PH2}$, between the horizontal and the line defining the length, $L_{PH2}$, and the angle, $\theta_{H2}$, with respect to the sheave 45 and between the horizontal and the line defining the length, $L_{H2}$.

Figure 8:
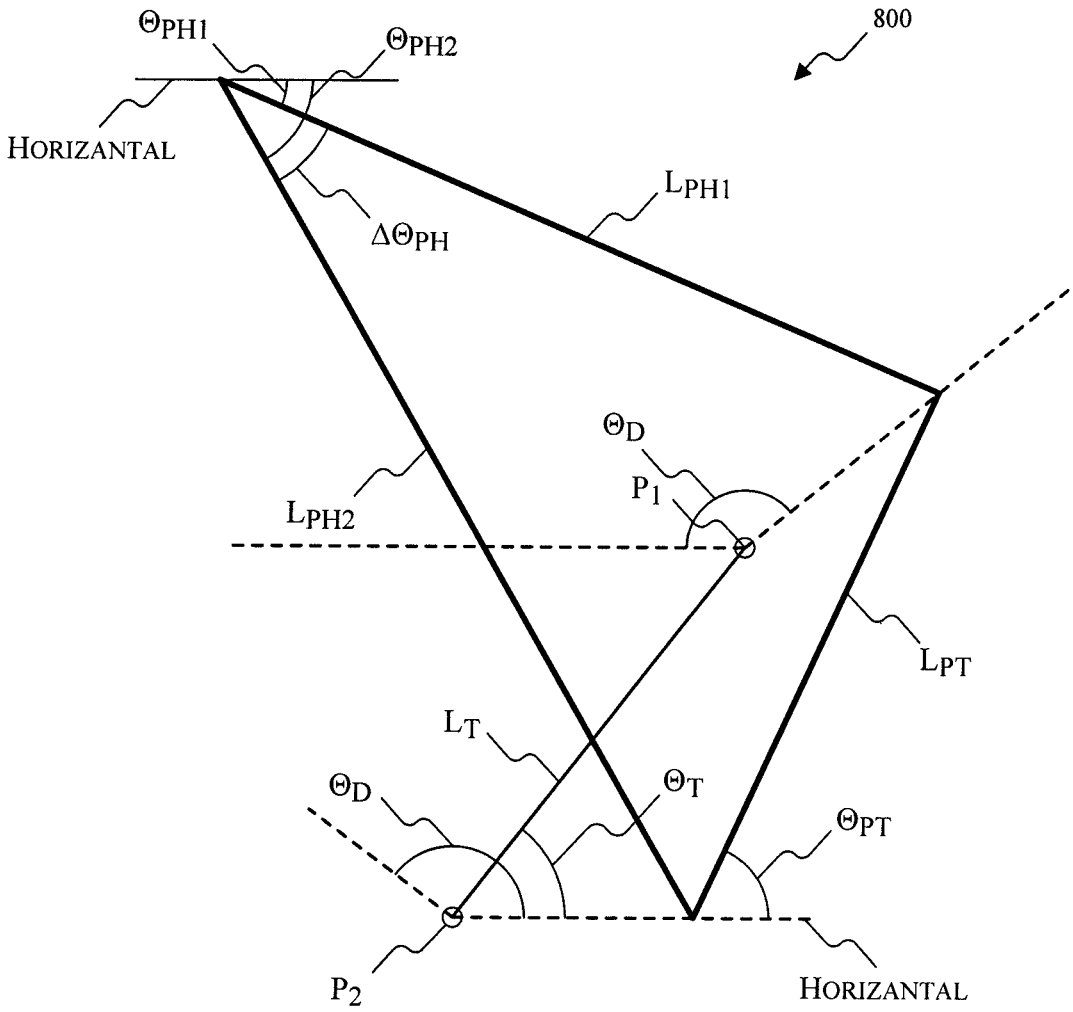

By combining the triangle 600 of FIG. 6 and triangle 700 of FIG. 7, the orientation of the shovel 10 can be described using a third triangle 800 defining the translation of the dipper from the first dipper position to the second dipper position. The third triangle 800 is illustrated in FIG. 8, where the point, $P_1$, corresponds to the position of the bail pin 105 at the first dipper position, and the point, $P_2$, corresponds to the position of the bail pin 105 at the second dipper position. The points P1 and P2 also define a length, $L_T$, of the line between the points P1 and P2 at an angle, $\theta_T$, with respect to the horizontal. The vector formed by the length, $L_T$, and the angle, $\theta_T$, corresponds to a displacement of the bail pin 105 from the first dipper position to the second dipper position. The value of the length, $L_T$, can be determined based on the values of $L_{H1}$, $\theta_{H1}$, $L_{H2}$, and $\theta_{H2}$. The triangle 800 further defines a line corresponding to the length, $L_{PT}$, between the edge of the dipper 70 in the first position and the edge of the dipper 70 in the second position, an angle, $\theta_{PT}$, between the line, $L_{PT}$, and the horizontal, and an angle, $\Delta\theta_{PH}$, defining the difference between the angles $\theta_{PH2}$ and $\theta_{PH1}$. The length of the line, $L_{PT}$, corresponds to the displacement of the dipper 70.

Using the variables described above, the values of length, $L_D$, and the angle, $\theta_D$, of dipper 70 can be determined or calculated. Additionally, lengths, $L_X$, and corresponding angles, $\theta_X$, can be combined to form a vector $L_X\theta_X$. This notation will be used throughout the application using appropriate subscripts to identify each vector. With reference once again to FIG. 6, the vector $L_{PH1}\theta_{PH1}$ can be defined as shown below in EQN. 1 with respect to the known variables $L_{H1}$, $\theta_{H1}$, $\theta_{C1}$, and unknown variables $L_D$, and $\theta_D$.

$$L_{H1}\theta_{H1}\pm L_D(\theta_{C1}+\theta_D)=L_{PH1}\theta_{PH1} \quad \text{EQN. 1}$$

The vectors of EQN. 1 can then be separated into corresponding horizontal and vertical components as shown below in EQNS. 2 and 3, respectively.

$$L_{H1}\cos(\theta_{H1})+L_D\cos(\theta_{C1}+\theta_D)=L_{PH1}\cos(\theta_{PH1}) \quad \text{EQN. 2}$$

$$L_{H1}\sin(\theta_{H1})+L_D\sin(\theta_{C1}+\theta_D)=L_{PH1}\sin(\theta_{PH1}) \quad \text{EQN. 3}$$

Similarly, and with reference once again to FIG. 7, the vector $L_{PH2}\theta_{PH2}$ can be defined as shown below in EQN. 4 with respect to the known variables $L_{H2}$, $\theta_{H2}$, $\theta_{C2}$, and unknown variables $L_D$, and $\theta_D$.

$$L_{H2}\theta_{H2}+L_3(\theta_{C2}+\theta_D)=L_{PH2}\theta_{PH2} \quad \text{EQN. 4}$$

The vectors of EQN. 4 can then also be separated into corresponding horizontal and vertical components as shown below in EQNS. 5 and 6, respectively.

$$L_{H2}\cos(\theta_{H2})+L_D\cos(\theta_{C2}+\theta_D)=L_{PH2}\cos(\theta_{PH2}) \quad \text{EQN. 5}$$

$$L_{H2}\sin(\theta_{H2})+L_D\sin(\theta_{C1}+\theta_D)=L_{PH2}\sin(\theta_{PH2}) \quad \text{EQN. 6}$$

With reference to FIG. 8, a trapezoid is formed between the position at point, $P_1$, of the bail pin 105, the edge of the dipper 70 at the first dipper position, the position at point, $P_2$, of the bail pin 105, and the edge of the dipper 70 at the second dipper position. Using the vectors formed by the translation of the dipper from the first dipper position to the second dipper position, a relation between the known variables $\theta_{C1}$, $\theta_{C2}$, $L_T$, and $\theta_T$, and the unknown variables $L_D$, $\theta_H$, $L_{PT}$, and $\theta_{PT}$ can be written as shown below in EQN. 7.

$$L_D(\theta_{C2}+\theta_D)+L_{PT}\theta_{PT}=L_T\theta_T+L_D(\theta_{C1}+\theta_D) \quad \text{EQN. 7}$$

EQN. 7 can then be solved for the vector $L_{PT}\theta_{PT}$, as shown below in EQN. 8.

$$L_{PT}\theta_{PT}=L_T\theta_T+L_D(\theta_{C1}+\theta_D)-L_D(\theta_{C2}+\theta_D) \quad \text{EQN. 8}$$

In a manner similar to that performed above with respect to EQNS. 1 and 4, EQN. 8 can be separated into corresponding horizontal and vertical components as shown below in EQNS. 9 and 10, respectively.

$$L_{PT}\cos(\theta_{PT})=L_T\cos(\theta_T)+L_D\cos(\theta_{C1}+\theta_D)-L_D\cos(\theta_{C2}+\theta_D) \quad \text{EQN. 9}$$

$$L_{PT}\sin(\theta_{PT})=L_T\sin(\theta_T)+L_D\sin(\theta_{C1}+\theta_D)-L_D\sin(\theta_{C2}+\theta_D) \quad \text{EQN. 9}$$

With continued reference to FIG. 8, the unknown variable $L_{PH2}$ can be written in terms of the known variables $L_{H1}$, $L_{H2}$, and $R_H$, and unknown variables $L_{PH1}$, $\theta_{PH1}$, and $\theta_{PH2}$.

$$L_{PH2}=L_{PH1}+(L_{H2}-L_{H1})-R_H(\theta_{PH2}-\theta_{PH1}) \quad \text{EQN. 11}$$

where the relationships of $(L_{H2}-L_{H1})=\Delta L_H$ (i.e., hoist displacement) and $(\theta_{PH2}-\theta_{PH1})=\Delta\theta PH$ can be used to simplify EQN. 11 and produce EQN. 12.

$$L_{PH2}=L_{PH1}+\Delta L_H-R_H(\Delta\theta_{PH}) \quad \text{EQN. 12}$$

Additionally, because the dipper 70 is rigidly attached to the dipper handle 85 and the hoist ropes 75, it can be assumed that the change in hoist angle, $\Delta\theta_H$, from the first dipper position to the second dipper position is the same as the change in the angle, $\Delta\theta_{PH}$, from the first dipper position to the second dipper position, as shown below in EQN. 13.

$$\theta_{H2}-\theta_{H1}=\Delta\theta_H=\Delta\theta_{PH}=\theta_{PH2}-\theta_{PH1} \quad \text{EQN. 13}$$

as such, EQN. 12 can be rewritten as shown below in EQN. 14.

$$L_{PH2}=L_{PH1}+\Delta L_H-R_H\Delta\theta_H \quad \text{EQN. 14}$$

EQN. 14 can then be substituted into EQNS. 5 and 6 to produce EQNS. 15 and 16 below.

$$L_{H2}\cos(\theta_{H2})+L_D\cos(\theta_{C2}+\theta_D)=[L_{PH1}+\Delta L_H-R_H\Delta\theta_H]\cos(\theta_{PH2}) \quad \text{EQN. 15}$$

$$L_{H2}\sin(\theta_{H2})+L_D\sin(\theta_{C2}+\theta_D)=[L_{PH1}+\Delta L_H-R_H\Delta\theta_H]\sin(\theta_{PH2}) \quad \text{EQN. 16}$$

As a result of the substitutions in EQNS. 15 and 16, the controller 200 can determine or calculate a solution for the length, $L_D$, and angle, $\theta_D$, of the dipper using EQNS. 2, 3, 9, 10, 13, 15, and 16, which have been reproduced below as EQNS. 17-23 for the purpose of clarity.

$$L_{H1}\cos(\theta_{H1})+L_D\cos(\theta_{C1}+\theta_D)=L_{PH1}\cos(\theta_{PH1}) \quad \text{EQN. 17}$$

$$L_{H1}\sin(\theta_{H1})+L_D\sin(\theta_{C1}+\theta_D)=L_{PH1}\sin(\theta_{PH1}) \quad \text{EQN. 18}$$

$$L_{H2}\cos(\theta_{H2})+L_D\cos(\theta_{C2}+\theta_D)=[L_{PH1}+\Delta L_H-R_H\Delta\theta_H]\cos(\theta_{PH2}) \quad \text{EQN. 19}$$

$$L_{H2}\sin(\theta_{H2})+L_D\sin(\theta_{C2}+\theta_D)=[L_{PH1}+\Delta L_H-R_H\Delta\theta_H]\sin(\theta_{PH2}) \quad \text{EQN. 20}$$

$$L_{PT}\cos(\theta_{PT})=L_T\cos(\theta_T)+L_D\cos(\theta_{C1}+\theta_D)-L_D\cos(\theta_{C2}+\theta_D) \quad \text{EQN. 21}$$

$$L_{PT}\sin(\theta_{PT})=L_T\sin(\theta_T)+L_D\sin(\theta_{C1}+\theta_D)-L_D\sin(\theta_{C2}+\theta_D) \quad \text{EQN. 22}$$

$$\Delta\theta_H=\theta_{H2}-\theta_{H1}=\theta_{PH2}-\theta_{PH1}=\Delta\theta_{PH} \quad \text{EQN. 23}$$

As such, the only unknown variables in EQNS. 17-23 are $L_D$, $\theta_D$, $L_{PH1}$, $\theta_{PH1}$, $\theta_{PH2}$, $L_{PT}$, and $\theta_{PT}$, which leaves seven equations and seven unknown variables. The above equations can be solved simultaneously to calculate values for the length, $L_D$ and the angle, $\theta_D$, of the dipper 70. In some embodiments, further substitutions may be used to simplify EQNS. 17-23. However, such substitutions may not be necessary because the controller 200 is capable of calculating the unknown variables without further simplification.

Figure 9:
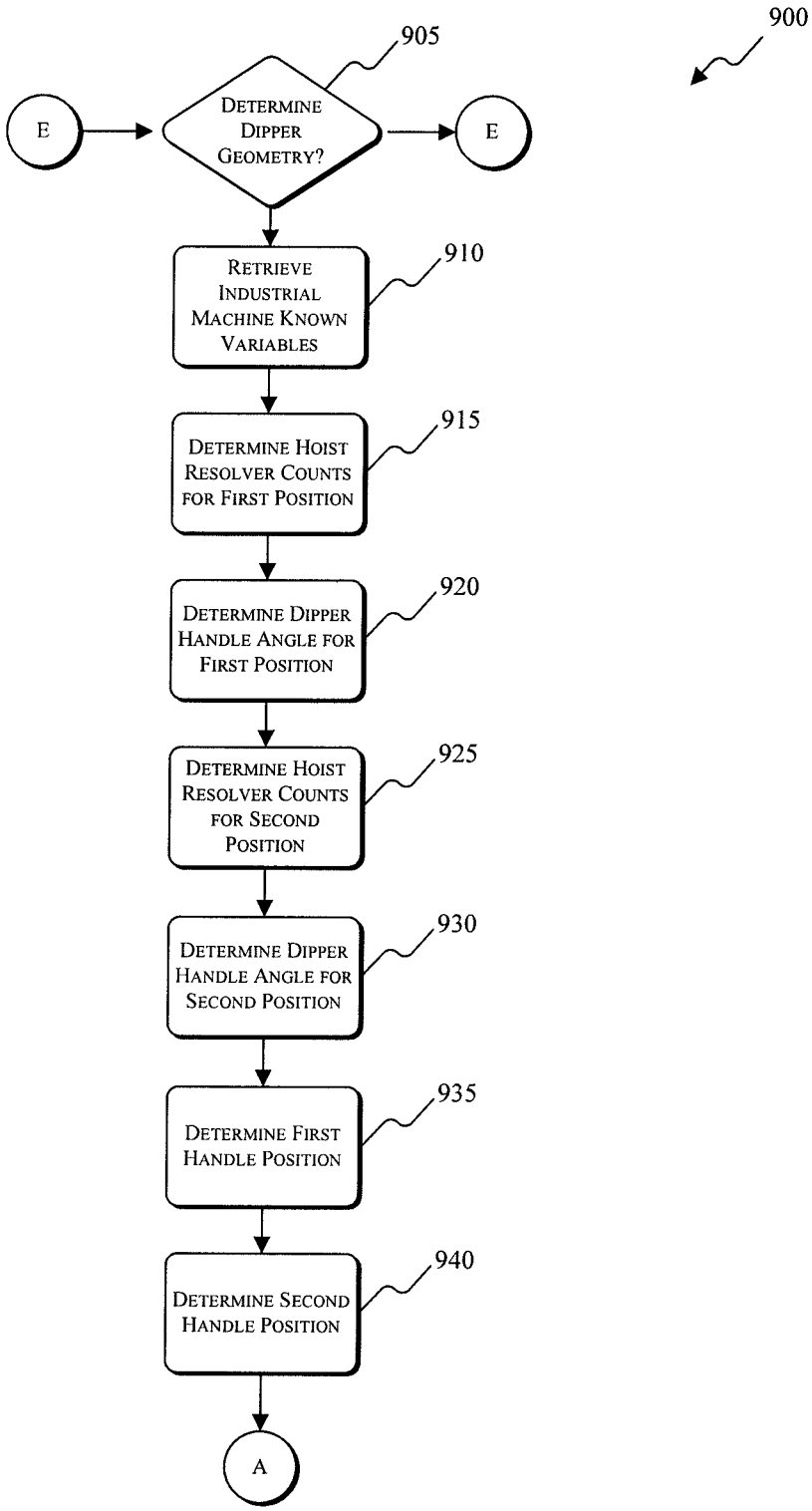
FIGS. 9-11 illustrate a process for determining dipper geometry according to an embodiment of the invention.
Figure 10:
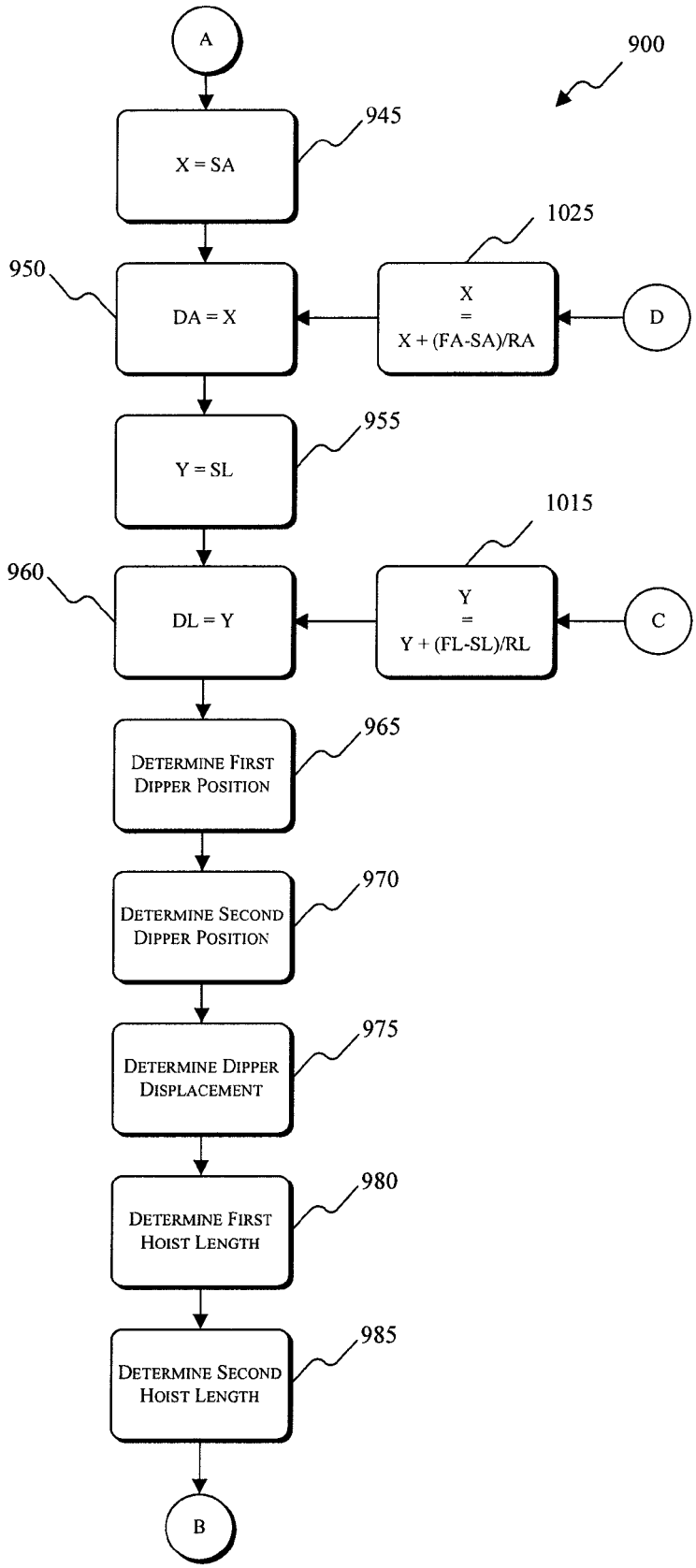
Figure 11:
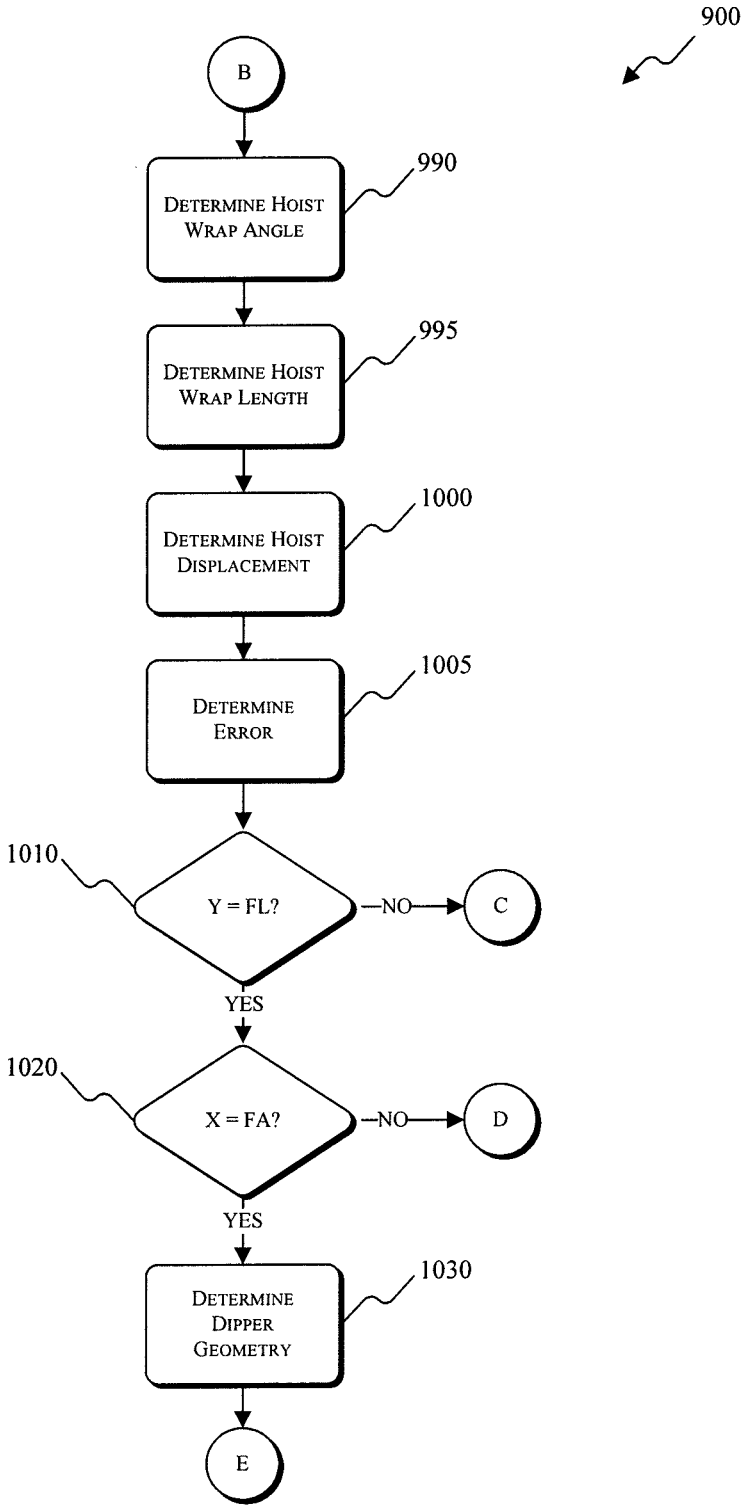

The above equations are provided as an illustrative example of how to determine dipper geometry. In other embodiments, different equations or modified equations may be used. Additionally or alternatively, an iterative solver can be used to determine the length, $L_D$, and the angle, $\theta_D$, of the dipper 70. For example, FIGS. 9-11 illustrate a process 900 for determining the geometry of the dipper 70 based on the above EQNS. 17-23. At step 905, a determination is made related to whether the geometry of the dipper 70 should be determined. For example, a user may provide an indication of the industrial machine 10 that the dipper geometry should be determined, or the industrial machine 10 can automatically determine whether the dipper geometry should be determined. Such a determination can be made based on, among other things, the current state of the shovel 10, the load in the dipper 70, the motion of the dipper 70, etc. In some embodiments, the dipper geometry is periodically determined (e.g., during a digging operation of the industrial machine 10 or during a controlled, no-load movement of the dipper 70). If, at step 905, the dipper geometry is to be determined, a set of known or calculated variables associated with the industrial machine 10 are retrieved from, for example, the memory 255 (step 910). The known or calculated variables include, for example, boom length, $L_B$, boom angle, $\theta_B$, dipper handle length, $L_C$, dipper handle angle, $\theta_C$, sheave radius, $R_H$, hoist resolver gain, $H_{RG}$, per inch of hoist rope, etc. In some embodiments, these variables are determined using one or more sensors (e.g., inclinometers, resolvers, proximity switches, etc.). These variables can also be used to determine other characteristics or values associated with the industrial machine 10. For example, the boom length and the boom angle can be used to determine a position of the sheave 45. If, at step 905, the dipper geometry is not to be determined, the process 900 returns to step 905 until the dipper geometry is to be determined. After steps 905 and 910, the hoist resolver counts (step 915) and dipper handle angle (step 920) are determined for a first dipper position. The hoist resolver counts (step 925) and dipper handle angle (step 930) are then determined for a second dipper position. A first position of the dipper handle 85 is determined based on the dipper handle angle and the length of the dipper handle 85 for the first dipper position (step 935). The first position of the dipper handle 85 can be determined as a vector quantity including both vertical and horizontal components, or the first position of the dipper handle 85 can be determined as individual vertical and horizontal components (e.g., using sine and cosine trigonometric functions on the dipper handle angle).

A second position of the dipper handle 85 is then determined based on the dipper handle angle and the length of the dipper handle 85 for the second dipper position (step 940). The second position of the dipper handle 85 can be determined as a vector quantity including both vertical and horizontal components, or the second position of the dipper handle 85 can be determined as individual vertical and horizontal components (e.g., using sine and cosine trigonometric functions on the dipper handle angle). The process 900 then proceeds to section A shown in and described with respect to FIG. 10.

After the first position of the dipper handle and the second position of the dipper handle have been determined, a dipper displacement, $L_{PT}$, and a hoist displacement, $\Delta L_H$, are iteratively determined. At step 945, a first variable, X, is set equal to a starting angle, SA. The starting angle, SA, corresponds to the angle, $\theta_D$, of the dipper 70 with respect to the dipper handle 85 that is used as a starting point in an iterative solver. The starting angle, SA, may have a value of between approximately 0° and approximately 60°. In some embodiments, the starting angle, SA, is approximately 45°. A dipper angle variable, DA, is then set equal to the first variable, X, (step 950). A second variable, Y, is set equal to a starting length, SL, of the dipper 70 (step 955), and a dipper length variable, DL, is set equal to the second variable, Y, (step 960). The starting length, SL, corresponds to the length, $L_D$, of the dipper 70 that is used as a starting point for the iterative solver. The starting length, SL, can correspond to the shortest dipper 70 that is used with the industrial machine 10. For example, the shortest dipper 70 that can be installed on a particular industrial machine may be known and programmed into the memory 255. In some embodiments, the starting length, SL, has a value of between zero and 100 inches. By selecting values for the dipper length, $L_D$, and the dipper angle, $\theta_D$, EQNS. 17-23 above do not need to be simultaneously solved. Rather, values for, among other things, dipper displacement, $L_{PT}$, hoist displacement, $\Delta L_H$, etc., can be used to directly calculate values for the otherwise unknown variables.

A first dipper position is then determined based on the first position of the dipper handle 85, the dipper angle, DA, the dipper length, DL, and the first dipper handle angle (step 965). In some embodiments, both vertical and horizontal components of the first dipper position are calculated. A second dipper position is then determined based on the second position of the dipper handle 85, the dipper angle, DA, the dipper length, DL, and the second dipper handle angle (step 970). In some embodiments, both vertical and horizontal components of the second dipper position are calculated. The first dipper position and the second dipper position are then used to calculate the displacement, $L_{PT}$, of the dipper 70 (step 975) from the first dipper position to the second dipper position. In some embodiments, the dipper displacement can be determined as shown below in EQN. 24.

$$\text{Dipper Displacement} = \sqrt{(DPos_{11}-DPos_{21})^2+(DPos_{12}-DPos_{22})^2} \qquad \text{EQN. 24}$$

Where $DPos_{11}$ is the horizontal position of the dipper 70 at the first dipper position, $DPos_{21}$ is the horizontal position of the dipper 70 at the second dipper position, $DPos_{12}$ is the vertical position of the dipper 70 at the first dipper position, and $DPos_{22}$ is the vertical position of the dipper 70 at the second dipper position.

After the dipper displacement has been calculated, a first hoist length is determined based on the first dipper position and the position of the sheave 45 (step 980), and a second hoist length is determined based on the second dipper position and the position of the sheave 45 (step 985).

Using the same nomenclature as above with respect to the dipper displacement, the first hoist length, $L_{H1}$, and second hoist length, $L_{H2}$, can be determined as shown below in EQNS. 25 and 26, respectively.

$$\text{First Hoist Length} = \sqrt{(DPos_{11}-SPos_1)^2+(DPos_{12}-SPos_2)^2} \qquad \text{EQN. 25}$$

$$\text{Second Hoist Length} = \sqrt{(DPos_{21}-SPos_1)^2+(DPos_{22}-SPos_2)^2} \qquad \text{EQN. 26}$$

where $SPos_1$ is the horizontal position of the sheave 45 based on the length of the boom 35 and the angle of the boom 35, and $SPos_2$ is the vertical position of the sheave 45 based on the length of the boom 35 and the angle of the boom 35. The process 900 then proceeds to section B shown in and described with respect to FIG. 11.

A hoist wrap angle is determined based on the radius of the sheave 45, the hoist first length calculated in step 980, and the second hoist length calculated at step 985 (step 990). For example, the hoist wrap angle is calculated based on a set of additional angles that correspond to the characteristic geometry of the industrial machine at the first dipper position and the second dipper position. A first angle is calculated or determined based on the radius of the sheave 45 and the first hoist length from EQN. 25, as shown below in EQN. 27.

$$\text{First Angle}=a\cos((\text{Sheave Radius})/(\text{First Hoist Length})) \quad \text{EQN. 27}$$

where acos is the arc or inverse cosine trigonometric function. A second angle is calculated or determined based on the radius of the sheave 45 and the second hoist length from EQN. 26, as shown below in EQN. 28.

$$\text{Second Angle}=a\cos((\text{Sheave Radius})/(\text{Second Hoist Length})) \quad \text{EQN. 28}$$

A third angle is calculated or determined based on $DPos_{11}$, $DPos_{12}$, $SPos_1$, and $SPos_2$ as shown below in EQN. 29.

$$\text{Third Angle}=a\tan 2(DPos_{12}-SPos_2, DPos_{11}-SPos_1) \quad \text{EQN. 29}$$

where atan 2 is the four-quadrant arc or inverse tangent trigonometric function. A fourth angle is calculated or determined based on $DPos_{21}$, $DPos_{22}$, $SPos_1$, and $SPos_2$ as shown below in EQN. 30.

$$\text{Fourth Angle}=a\tan 2(DPos_{22}-SPos_2, DPos_{21}-SPos_1) \quad \text{EQN. 30}$$

The change in hoist angle or hoist wrap angle, $\Delta\theta_H$, is then determined as shown below in EQN. 31.

$$\text{Hoist WrapAngle}=(\text{FirstAngle}+\text{SecondAngle})-(\text{ThirdAngle}+\text{FourthAngle}) \quad \text{EQN. 31}$$

The amount or length of hoist wrap that occurs (positive or negative) when moving the dipper 70 from the first dipper position to the second dipper position is determined based on the hoist wrap angle and the radius of the sheave 45 (step 995), as shown below in EQN. 32.

$$\text{Hoist Wap Length}=(\text{Hoist Wap Angle})\times(\text{Sheave Radius}) \quad \text{EQN. 32}$$

As such, the amount of hoist displacement, $\Delta L_H$, that occurs when moving the dipper 70 from the first dipper position to the second dipper position can be calculated using the known values of hoist resolver gain, $H_{RG}$, the hoist resolver counts, $H_{RC}$, for the first dipper position, the hoist resolver counts, $H_{RC}$, for the second dipper position, and the length of the hoist wrap that occurred from the first dipper position to the second dipper position (step 1000). In some embodiments, the hoist displacement is calculated as shown below in EQN. 33.

$$\text{Hoist Displacement}=\text{abs}(H_{RG}\times(H_{RCP1}-H_{RCP2})-\text{HoistWrapLength}) \quad \text{EQN. 33}$$

The hoist displacement calculated at step 1000 and the dipper displacement calculated at step 975 are then compared to one another in order to determine an error (step 1005) associated with the selected values for the dipper length, $L_D$, and the dipper angle, $\theta_D$, with respect to the dipper handle 85. The error can be calculated as shown in EQN. 34

$$\text{Error}=\text{abs}((\text{Hoist Displacement})-(\text{Dipper Displacement})) \quad \text{EQN. 34}$$

If the dipper angle and the dipper length are both correct, the hoist displacement and the dipper displacement are equal or approximately equal and the error is approximately zero. The error determined at step 1005 can be stored in, for example, the memory 255 or the database 230 for comparison to the error values for other dipper angle and dipper length combinations.

At step 1010, the second variable, Y, is compared to a final dipper length variable, FL. The final dipper length variable, FL, represents the greatest possible length for the dipper 70. In some embodiments, the final dipper length is based on commercially sold dippers 70 that can be installed on the industrial machine 10. In other embodiments, the final dipper length, FL, is set to a value that is well above the greatest possible dipper length (e.g., 500 inches or greater) in order to ensure that every possible dipper length is tested. If, at step 1010, the second variable, Y, is not equal to the final dipper length, the process 900 proceeds to step 1015 of section C shown in and described with respect to FIG. 10. At step 1015, the second variable, Y, is incremented by a value corresponding to the current value of the second variable, Y, summed with the difference between the final dipper length, FL, and the starting dipper length, SL, divided by the resolution of the dipper length, RL, (e.g., the precision for which the dipper length is to be determined), as shown below in EQN. 35.

$$Y = Y + \frac{(FL - SL)}{RL} \quad \text{EQN. 35}$$

The dipper length, DL, is then set to the new value for the second variable, Y, (step 960). If, at step 1010, the second variable, Y, is equal to the final dipper length, the process 900 proceeds to step 1020 where the first variable, X, is compared to the final dipper angle, FA. The final dipper angle, FA, corresponds to the greatest possible angle of the dipper 70 with respect to the dipper handle 85. The final dipper angle, FA, may have a value of between approximately 60° and approximately 90°. In some embodiments, the starting angle, SA, is always set to a value of 0° and the final dipper angle is always set to a value of 90° with respect to the dipper handle 85. If, at step 1020, the first variable, X, is not equal to the final dipper angle, the process 900 proceeds to step 1025 in section D shown in and described with respect to FIG. 10. At step 1025, the first variable, X, is incremented by a value corresponding to the current value of the first variable, X, summed with the difference between the final dipper angle, FA, and the starting angle, SA, divided by the resolution of the dipper angle, RA, (e.g., the precision for which the dipper angle is to be determined), as shown below in EQN. 36.

$$X = X + \frac{(FA - SA)}{RA} \quad \text{EQN. 36}$$

The dipper angle, DA, is then set to the new value for the first variable, X, (step 950). If, at step 1020, the first variable, X, is equal to the final dipper angle, the dipper geometry is determined (step 1030).

The dipper geometry is determined, for example, by comparing each of the errors determined for the set dipper angles and dipper lengths. The process 900 is configured in such a manner to calculate or determine an error value associated with each of the possible dipper lengths (i.e., depending on the dipper length resolution) in combination with each of the possible dipper angles (i.e., depending on the dipper angle resolution). The dipper length, $L_D$, and dipper angle, $\theta_D$, combination that produces the smallest error (i.e., the error closest to zero) are selected as the dipper geometry. In some embodiments, an error value of exactly zero is never achieved due to the resolution of dipper angle increments and the resolution of the dipper length increments. The iterative method of process 900 is an illustrative example of one technique and process for solving for dipper geometry according to the invention. In other embodiments, the process 900 can be adapted to use additional or different techniques and methods for solving for the geometry of the dipper 70. For example, a gradient of the error value can be used or a Newton-Raphson approximation method can be used, as well as other techniques for solving for the geometry of the dipper 70 based on the above-described equations and relationships. As described above, the determined dipper geometry is then provided to, for example, a collision avoidance system, a payload determination system, a position detection system associated with the industrial machine 10.

Thus, the invention provides, among other things, systems, methods, devices, industrial machines, and computer readable media for determining the geometry of a dipper. Various features and advantages of the invention are set forth in the following claims.

What is claimed is:

1. A method of determining a value of a physical characteristic associated with a dipper of an industrial machine, the method comprising:

obtaining a first set of data associated with an industrial machine for a first orientation of the industrial machine, the first set of data including at least one of a first length associated with a hoist rope and a first angle associated with the hoist rope;

obtaining a second set of data associated with the industrial machine for a second orientation of the industrial machine, the second set of data including at least one of a second length associated with the hoist rope and a second angle associated with the hoist rope; and determining, using a processor, the value of the physical characteristic of the dipper based on the first set of data and the second set of data.

2. The method of claim 1, wherein the characteristic of the dipper is a length of the dipper.

3. The method of claim 1, wherein the characteristic of the dipper is an angle of the dipper with respect to a dipper handle.

4. The method of claim 1, further comprising iteratively solving for the value of the physical characteristic of the dipper.

5. The method of claim 1, wherein determining the value of the physical characteristic of the dipper includes solving a set of simultaneous equations for the value of the physical characteristic.

6. The method of claim 1, further comprising determining a displacement of the dipper and a displacement of the hoist rope.

7. The method of claim 6, further comprising calculating an error value based on the displacement of the dipper and the displacement of the hoist rope.

8. An industrial machine comprising:

a dipper;

a boom and a sheave supporting a hoist rope, the hoist rope connected to the dipper; and a controller configured to control a length of the hoist rope, determine a first length of the hoist rope, the first length corresponding to a first position of the dipper, determine a second length of the hoist rope, the second length corresponding to a second position of the dipper, determine a first angle of the hoist rope with respect to the sheave, the first angle corresponding to the first position of the dipper, determine a second angle of the hoist rope with respect to the sheave, the second angle corresponding to the second position of the dipper, determine a displacement of the hoist rope based on the first length, the second length, the first angle, and the second angle, and determine a value for a physical attribute of the dipper based on the displacement of the hoist rope.

9. The industrial machine of claim 8, wherein the physical attribute of the dipper is a length of the dipper.

10. The industrial machine of claim 8, wherein the physical attribute of the dipper is an angle of the dipper with respect to a dipper handle.

11. The industrial machine of claim 8, wherein the controller is further configured to iteratively solve for the value of the physical attribute of the dipper.

12. The industrial machine of claim 8, wherein determining the value of the physical attribute of the dipper includes solving a set of simultaneous equations for the value of the physical attribute.

13. The industrial machine of claim 8, wherein the controller is further configured to determine a displacement of the dipper and a displacement of the hoist rope.

14. The industrial machine of claim 13, wherein the controller is further configured to calculate an error value based on the displacement of the dipper and the displacement of the hoist rope.

15. A method of determining a value for a length associated with a dipper of an industrial machine, the method comprising:

determining, using a processor, a first length of a hoist rope associated with a first position of the dipper;

determining, using the processor, a first angle of the hoist rope with respect to a sheave and associated with a first position of the dipper;

determining, using the processor, a second length of the hoist rope associated with a second position of the dipper;

determining, using the processor, a second angle of the hoist rope with respect to the sheave and associated with a second position of the dipper; and determining, using the processor, the value for the length of the dipper based on the first length of the hoist rope, the second length of the hoist rope, the first angle of the hoist rope with respect to the sheave, and the second angle of the hoist rope with respect to the sheave.

16. The method of claim 15, wherein determining the value for the length of the dipper includes solving a set of simultaneous equations for the value.

17. The method of claim 15, further comprising selecting a test value for the length of the dipper and iteratively modifying the test value through a range of values for the length of the dipper.

18. The method of claim 17, further comprising determining a displacement of the dipper and a displacement of the hoist rope for each iteration of the test value.

19. The method of claim 18, further comprising calculating an error value based on the displacement of the dipper and the displacement of the hoist rope for each iteration of the test value.

20. The method of claim 19, further comprising determining the test value for the length of the dipper that produces a minimum error value.

* * * * *